US006976442B2

(12) United States Patent
Hey et al.

(10) Patent No.: US 6,976,442 B2
(45) Date of Patent: Dec. 20, 2005

(54) VARIABLE RANGE APPARATUS FOR WATERCRAFT LIFT

(75) Inventors: Kenneth E. Hey, Mercer Island, WA (US); Bryce Morgan Kloster, Snoqualmie, WA (US)

(73) Assignee: Sunstream Corporation, Kent, WA (US)

( * ) Notice: Subject to any disclaimer, the term of this patent is extended or adjusted under 35 U.S.C. 154(b) by 0 days.

(21) Appl. No.: 11/051,342

(22) Filed: Feb. 3, 2005

(65) Prior Publication Data

US 2005/0235893 A1 Oct. 27, 2005

Related U.S. Application Data

(60) Provisional application No. 60/541,277, filed on Feb. 3, 2004.

(51) Int. Cl.[7] ..... B63C 7/00
(52) U.S. Cl. ..... 114/44; 405/3
(58) Field of Search ..... 114/44, 45, 48; 405/3, 7

(56) References Cited

U.S. PATENT DOCUMENTS

| | | | | |
|---|---|---|---|---|
| 4,468,150 | A * | 8/1984 | Price | 405/7 |
| 5,184,914 | A * | 2/1993 | Basta | 405/3 |
| 5,888,019 | A * | 3/1999 | Quastad | 405/3 |
| 5,890,835 | A * | 4/1999 | Basta et al. | 405/3 |
| 5,908,264 | A * | 6/1999 | Hey | 405/3 |
| 5,919,000 | A * | 7/1999 | Unkle | 405/3 |
| 6,318,929 | B1 * | 11/2001 | Basta | 405/3 |
| 6,575,661 | B1 * | 6/2003 | Phillips et al. | 405/3 |
| 6,830,002 | B1 * | 12/2004 | Walker | 114/44 |
| 6,848,379 | B1 * | 2/2005 | Ylipelkonen | 114/44 |

* cited by examiner

*Primary Examiner*—Lars A. Olson
(74) *Attorney, Agent, or Firm*—George C. Rondeau, Jr.; Davis, Wright, Tremaine LLP

(57) ABSTRACT

The invention generally relates to an apparatus and method that allows the lifting range of a four-bar, ground-based watercraft lift to be adjustable. More particularly, it relates to a ground-based watercraft that that allows for the lifting range of a watercraft support structure to be adjustable relative to the base of a watercraft lift while also maintaining the lift's shallow water functionality.

21 Claims, 10 Drawing Sheets

VARIABLE RANGE APPARATUS FOR WATERCRAFT LIFT

This application claims benefit of Provisional Application No. 60/541,277 filed Feb. 3, 2004.

TECHNICAL FIELD

The invention generally relates to an apparatus and method that allows the lifting range of a four-bar, ground-based watercraft lift to be adjustable. More particularly, it relates to a ground-based watercraft that that allows for the lifting range of a watercraft support structure to be adjustable relative to the base of a watercraft lift while also maintaining the lift's shallow water functionality.

BACKGROUND OF THE INVENTION

The use of a watercraft lift to protect a watercraft from the elements and to ease watercraft user access to a watercraft is well known. Out-of-water storage prevents damage resulting from boat contact with docks, other craft or floating debris. It reduces the possibility of the boat breaking free from its moorage and floating adrift or running aground. Out-of-water storage also lessens boat damage associated with long-term exposure to water and water-based pollutants and the attachment of barnacles or other marine growth to the boat's hull. Once a boat is lifted it can be maintained in its position for extended periods of time, relieving the user of maintenance concerns. A number of lift designs are currently know that provide this basic function. An example of one type of watercraft lift is described in U.S. Pat. No. 5,908,264 to Hey, which is incorporated by reference herein. In its preferred embodiment, a front, a rear and two sides form a rectangular base frame. The frame supports upwardly extending, pivoting booms that are connected to a watercraft platform (typically bunks) upon which the watercraft is positioned. The base frame, booms, and platform combine to form a parallelogram shape when viewed from the side. A hydraulic cylinder connected diagonally across the parallelogram actuates the lift. Extension of the cylinder rotates the booms about their lower end connection to the base frame. Thus, the rotation of the booms moves the watercraft platform (and thus the watercraft on the bunks) between raised and lowered positions. The type of lift described above is often referred to as a four-bar mechanism. U.S. Pat. No. 5,184,914 to Basta and U.S. Pat. No. 5,275,505 to Wilcox demonstrate this type of lift.

Current four-bar lifts, however, suffer from a number of disadvantages in that the current state-of-the art does not include a means and method by which the lifting range of a four-bar lift may be adjusted, which in turn reduces the utility of the device for end-users, manufacturers, and dealers.

For the user, the efficacy and usefulness of the watercraft lift is dependent upon the user's ability to access the watercraft support platform and thereby to enable watercraft ingress and egress to and from the platform. This, in turn, is contingent upon the vertical range of the watercraft platform, which is dictated by the length of the pivoting booms and the maximum angles of movement of those booms relative to horizontal. The use of the watercraft lift will be restricted to situations when the subject water level is within this functional range. If the subject water level drops below this range, the user either will not be able to float his watercraft onto the watercraft support structure, or the watercraft will be stranded on the watercraft support structure. If the subject water level rises above this range, the user will be unable to lift his watercraft above water level and the benefits of the watercraft lift will be lost. Water level variability in different water bodies as well as long-term fluctuation of water levels in specific water bodies caused by such events as seasonal variations in water level, draught or flooding, or governmental water use practices causes a need for a variable range adjustment apparatus for watercraft lifts which will allow the user to adjust the functional range of the watercraft lift for the particular water body in which the watercraft lift will be used.

Boatlift manufacturers currently address the above-stated difficulties by designing, manufacturing and selling four-bar watercraft lifts with booms of the maximum length possible after load constraints are taken into account. There are, however, situations where these large functional ranges create problems and the user would rather adjust the lift to decrease range. A large range may cause the watercraft support structure to be too deep in the water in the fully down position, thereby causing the user to be unable to easily see the watercraft support structure when positioning the boat for lifting and causing an operational time lag. A large range may also cause the watercraft support structure to be too high in the raised position, causing the watercraft to be relatively high in relation to the watercraft entry point, which may be a stationary dock or seawall. This, in turn, may create user access difficulties and safety concerns. Shoreline aesthetics may be also adversely affected by a watercraft that is positioned high above nearby docks—shoreline views of the waterbody and surrounding environment may be blocked by a highly lifted watercraft.

Alternatively, manufacturers may offer lifts with several lifting ranges: Lifts are supplied to dealers with three, four, and five foot booms used to connect the watercraft-supporting bunks to the watercraft base. This creates inventory control difficulties for the manufacturer and dealer in that multiple lifts with the same capacity requirements must be stocked to service the market.

The use of variable range apparatuses in four-bar type lifts is not currently known. The difficulty that has apparently restricted innovation in this area and which is addressed by the current invention is that of excessive loads placed on the booms during operation of the four-bar lift. In the four-bar design, loads placed on the booms increase dramatically as the booms rotate downward and the angles between the boom and the base frame and watercraft platform change from approximately 90 degrees to approximately 180 degrees. Increasing the length of the booms to increase lifting range also cause loads to increase significantly.

A telescoping connection between the watercraft platform and watercraft frame is known to Quastad, U.S. Pat. No. 5,888,019. Quastad describes a ground-based lift with upstanding telescoping posts that are height adjustable. The telescoping post connect the lift's frame to the watercraft support platform and maintain their relative vertical orientation throughout the operation of the lift. The difficulty presented by Quastad's device is that the lifting range of the lift is not actually adjustable. Rather, the vertical position of the base frame relative to the bunks is adjusted, but no increase in the lifting range from the lowered position to the raised position is obtained. The constant vertical position of Quastad's vertical posts cause the difficulty that use of the lift in shallow waters is limited. Because the vertical posts maintain their vertical orientation, the water depth at which Quastad's device may be used is directly and negatively impacted by the user's adjustment of the posts to an elongated position.

BRIEF SUMMARY OF THE INVENTION

In accordance with the present invention, a four-bar type watercraft lift is provided that pivots between raised and lowered positions. The lift includes a substantially rectangular base with longitudinal side beams and front, rear, and intermediate transverse beams connected to the longitudinal beams. The intermediate transverse beam is located between the front and rear transverse beams and at a height lower than the front and rear transverse beams. Forward booms are pivotally connected to the base at a location near the front transverse beam. Rear booms are pivotally connected to the base at a location near the intermediate transverse beam. A watercraft support platform is pivotally connected to the forward and rear booms.

The raising and lowering of the lift is accomplished by an actuation assembly. In a preferred embodiment, the actuation assembly includes two dual-directional high pressure hydraulic cylinders connected between the intermediate transverse beam and the rear booms. During use, the actuator assembly rotates the booms upward and forward about their pivotable connection to the base further raising the watercraft support platform and the watercraft to an over-center position. Preferred embodiments include two high pressure hydraulic cylinders operating at a pressure in the range of about 1000 psi to 3000 psi. In an alternative embodiment, the actuation assembly includes one or more low pressure water cylinders, preferably operating at a pressure in the range of about 40 psi to about 125 psi.

In accordance with other aspects of the invention, the lift's fully raised position is in the range of about 1 degree to about 12 degrees over center from vertical. Preferred embodiments are formed with the forward booms being a longer length than the rear booms such that the platform is tilted downward in the aft direction, the angle of tilt lessening in going from the lowered position to the raised lift position.

In accordance with further aspects of the invention, an independent power supply unit is provided including a sealed housing, a battery, a motor, a pump, a reservoir, and a control unit. The battery, motor pump, a reservoir, and control unit are positioned within the sealed housing and are capable of activating the actuation assembly. The power supply unit further includes a solar panel connected to the battery and located within the sealed housing. An optional remote control transmitting device is in communication with the control unit to activate the control unit and the lift actuation assembly without the operator having to physically go from the boat to the dock.

The components of the forward and rear booms of the present invention constitute a variable range apparatus for allowing the adjustment of the lifting range of the watercraft support structure relative to the base of a watercraft lift. The variable range apparatus includes an elongated, hollow "male" extrusion of a predetermined length and an elongated, hollow "female" extrusion of a predetermined length: the male extrusion having predetermined width dimensions so as to allow the extrusion to slideably penetrate into and couple with the corresponding "female" hollow extrusion, which in turn has predetermined width dimensions so as to allow the slideable penetration of the male extrusion. The lower portion of the boom is constructed by welding the ends of a horizontal beam to the two female or male extrusions forming the lower portion, thereby forming an "H" frame. The total length/height of the variable range is adjustable by sliding the corresponding male extrusions into the female extrusions or the if the lower portion is formed of male portions sliding the corresponding female onto the male extrusions forming the "H" frame to predetermined points along the side of the extrusions. These predetermined points are indicated by corresponding holes situated along the length of each extrusion, said holes having predetermined dimensions that allow for the insertion of a bolts, pin, or other device which in turn secures the position of the corresponding extrusions in a stationary relationship to one another, allowing for movement of the variable range apparatus as a unit without further change in its length. The variable range apparatus in the preferred embodiment, generally constructed of metal, has sufficient stiffness and load-bearing properties to bear the weight of the watercraft transmitted through the watercraft support structure, while the securing bolt, pin or other device may be quickly removed and the male and female extrusions adjusted when the weight of the watercraft is removed.

In one aspect of the invention, the variable range apparatus is incorporated into first and second boom assemblies that are rotatable in a substantially vertical plane and which connect the watercraft lift base to the watercraft support structure. In one embodiment the male extrusions of the height adjustment apparatus are incorporated into the boom assemblies as the upper members that partially form the complete boom assemblies.

BRIEF DISCRIPTION OF THE DRAWINGS

DETAILED DESCRIPTION OF THE INVENTION

The invention generally relates to an apparatus and method that allows the lifting range of a four-bar, ground-based watercraft lift to be adjustable. More particularly, it relates to a telescoping boom apparatus that allows for the lifting range of a watercraft support structure to be adjustable relative to the base of a watercraft lift while also maintaining the lift's shallow water functionality and maintaining the loads on the booms to within a safe and functional operating range.

Figure 1:
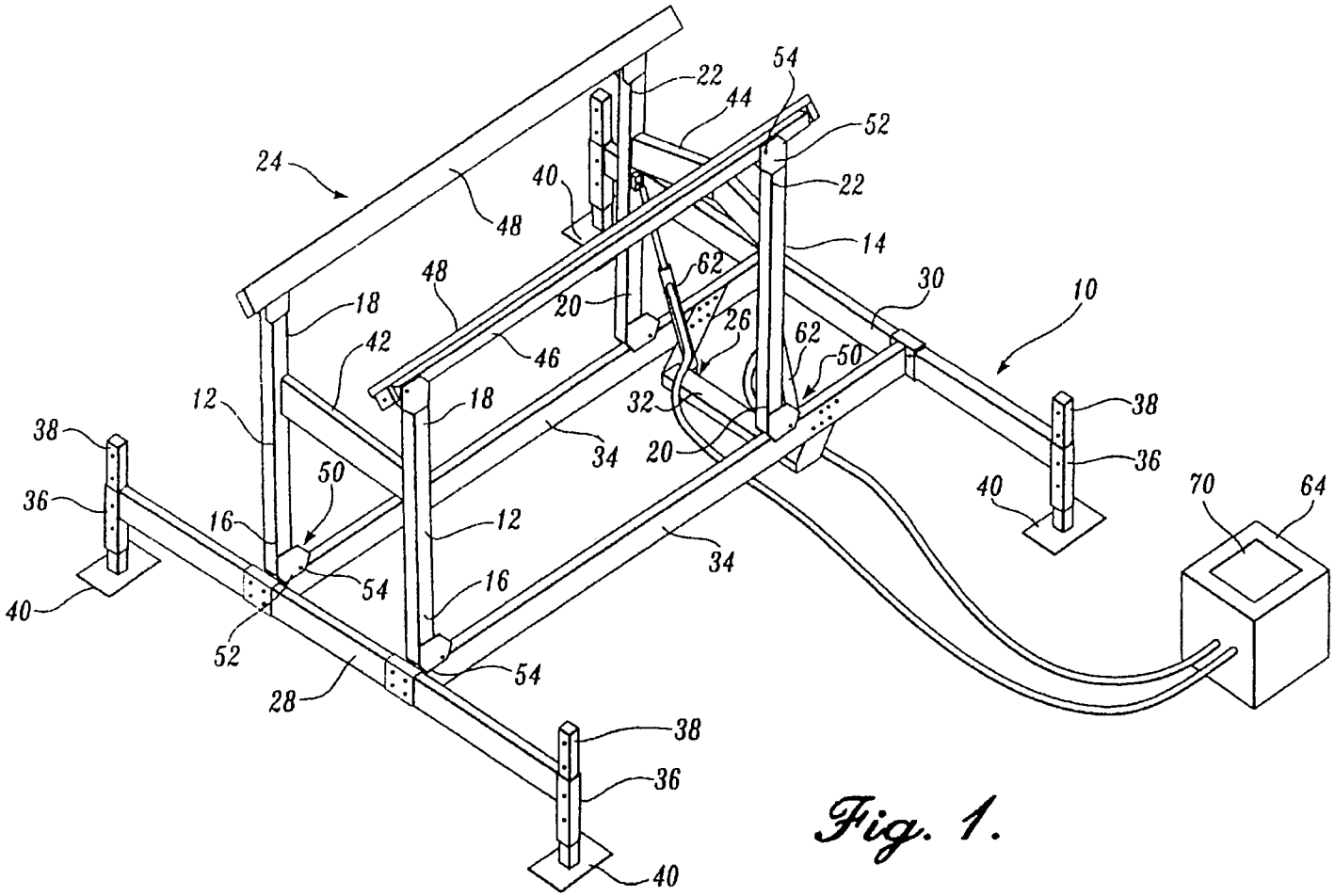
Fig. 1. (Prior Art)
FIG. 1 is an isometric view of a prior art watercraft lift.

An isometric view of the prior art is depicted in FIG. 1. A watercraft lift constituting the prior art includes a rectangular base 10 and forward and rearward pairs of pivoting booms 12, 14 with proximal and distal ends 16, 18, and 20, 22 respectively. The booms 12, 14 are rotatable attached at the their proximal ends 16, 20 to the base 10 and rotatably attached at their distal ends 18, 22 to a watercraft support platform 24. The support platform 24 is arranged to receive and support a watercraft (not shown). The lift further includes an actuation assembly 26 for pivoting the booms 12, 14 about proximal connections to the base. This action causes the booms, and hence the support platform and watercraft, to move between raised and lowered positions.

Referring still to FIG. 1, the base 10 includes a front transverse beam 28, a rear transverse beam 30, and an intermediate transverse beam 32 located therebetween. The transverse beam 28, 30, 32 are positioned parallel to one another and are connected to a pair of parallel longitudinal side beams 34. The front and rear transverse beams 28, 30 are horizontally oriented at one height, while the intermediate transverse beam 32 is horizontally oriented at a second, lower, height. (See FIG. 2). The ends of the front and rear transverse beams extend laterally outward of the longitudinal side beams 34 and include upright sleeves 36. The sleeves 36 receive support posts 38 that include lower end foot pads 40 capable of resting on a waterbody substrate. The forward booms 12 and the rear booms 14 are each pivotally connected to the longitudinal side beams 34 near the front and intermediate transverse beams 28, 32 respectively. Forward and rearward cross supports 42, 44 provide structural rigidity between the forward and rear pairs of booms 12, 14. Still referring to FIG. 1, the watercraft support platform 24 includes a pair of bunk beams 46 oriented parallel to the longitudinal side beams 34 and within the general upright plane of the forward and rear booms. The boom distal ends 18, 22 are pivotally joined to the bunk beams using offset pivot joints 50.

Figure 2:
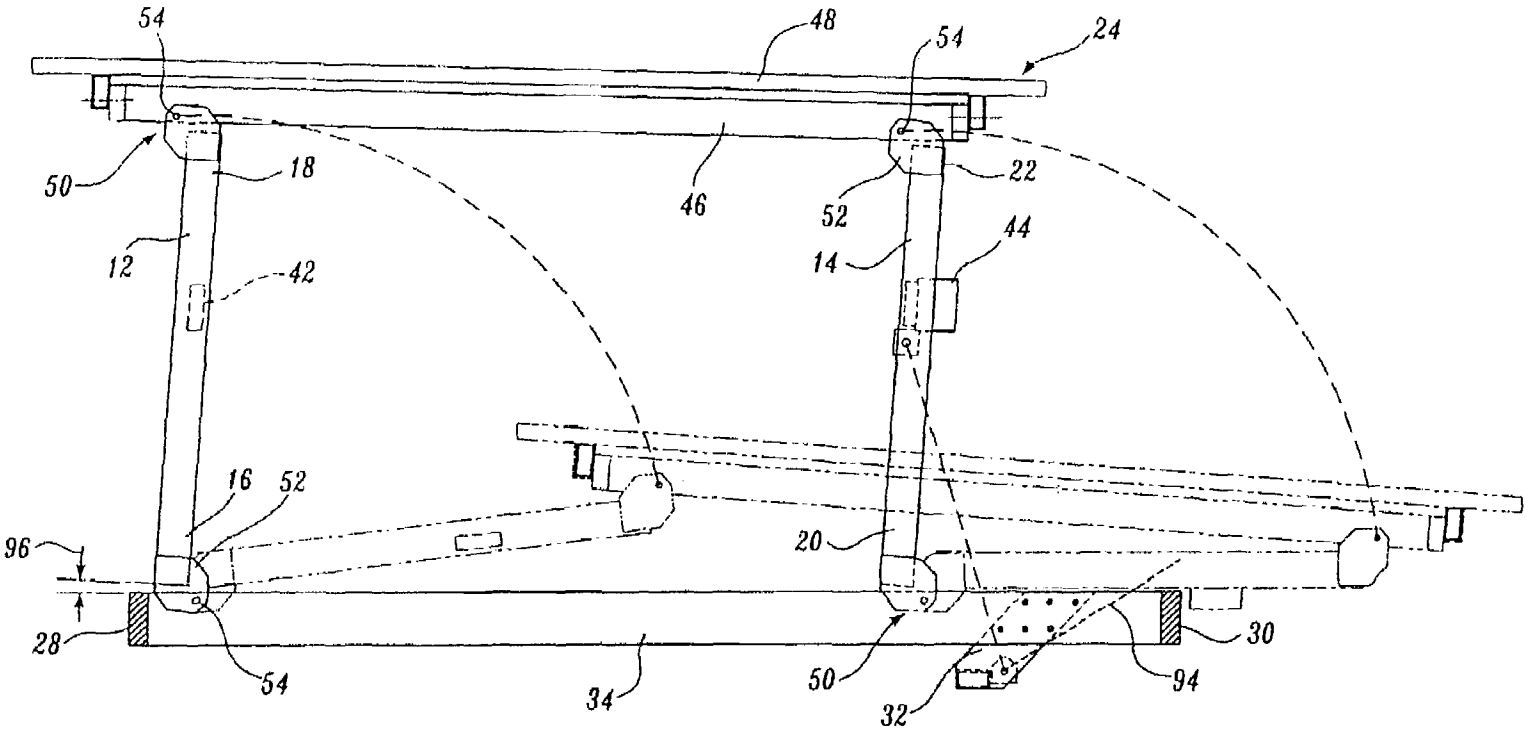
Fig. 2. (Prior Art)
FIG. 2 is a side view of the prior art watercraft lift, showing the lift in a raised position, phantom lines indicating the lift in a lowered position.

Referring to FIG. 2, the boom distal ends 18, 22 include a structural portion that is laterally offset forward from the longitudinal centerline of the boom. The offset portion is formed from a pair of plates 52 welded to each boom distal end. The plates straddle the bunk beams 46 and are pivotally held to the beam by rotatable pins 54. The boom proximal ends 16, 20 are pivotally connected to the longitudinal side beams 34 in a similar manner, though laterally offset in a rearward direction. In going between raised and lowered positions, the booms pivot relative to the bunk beams and longitudinal side beams about these pins 54. The booms 12, 14 do not contact the longitudinal side beams 34 and bunk beams 46 except at the offset pivot joints. In the raised position of FIG. 2, the boom distal end pins are slightly forward of the boom proximal end pins. The lift's raised position is thus said to be "overcenter", meaning that the load path through the booms is not vertical, but is angularly past vertical. This position provides a secondary or "gravity" lock.

Figure 3:
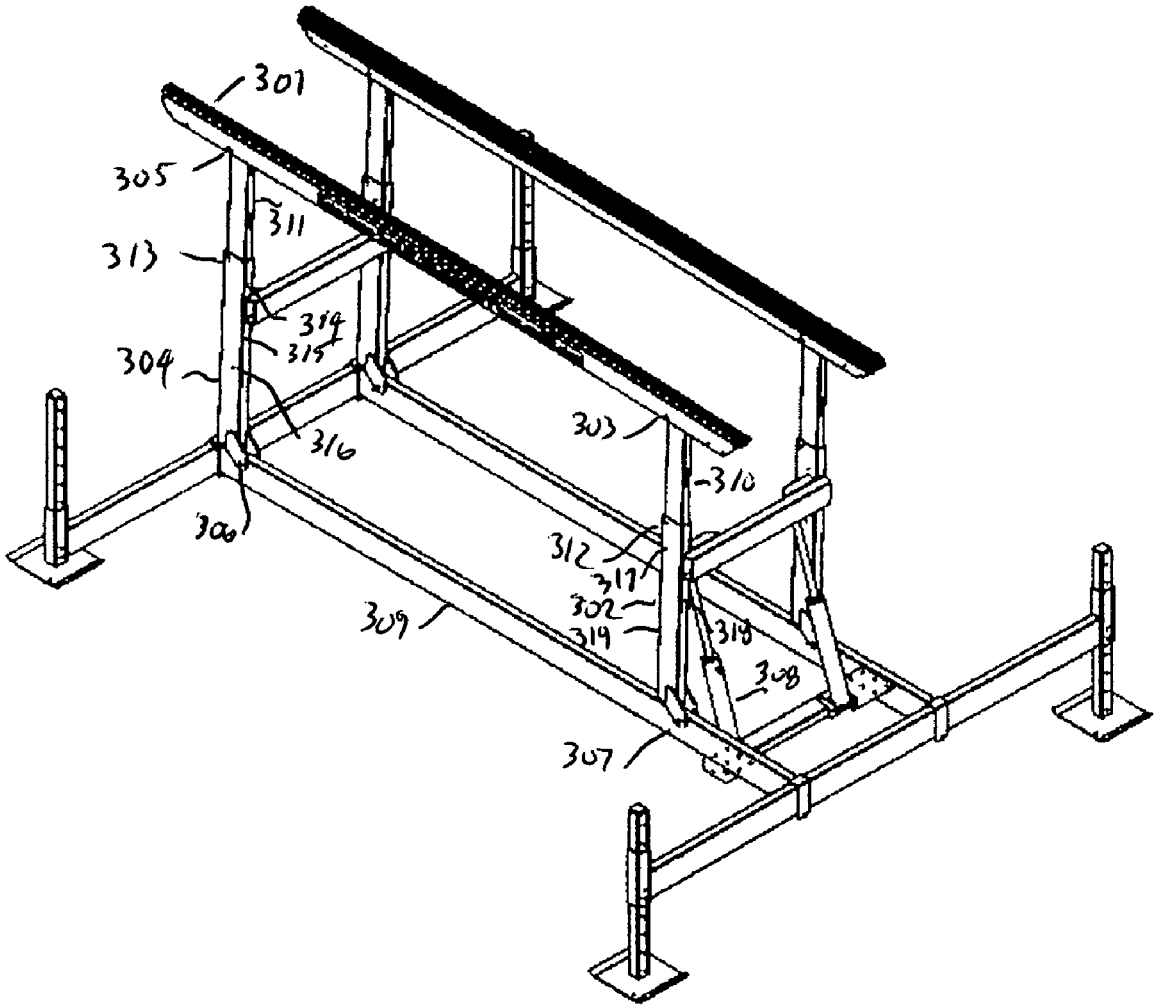
FIG. 3 is an isometric view of a watercraft lift incorporating the present invention.

FIG. 3 is an isometric view of a preferred embodiment of the boat lift in the 5 foot range configuration, in the highest and over-center position. This configuration has a 3 foot range base lift, and uses internal adjustable telescopic members 310 to extend the range to either 4 or 5 feet. The watercraft platform 301 is close to parallel in relation to the frame 309, which allows the boat to sit horizontally. The rear boom 302 is pivotally attached to the frame 309 with hole and pin 307. The upper pivot hole of the adjustable telescoping member 303 is pivotally attached to the watercraft platform 301. The adjustable telescoping member 310 is secured to the rear boom at adjustment holes 317, 318, 319. The forward boom 304 is pinned to the frame 309 with pin 306. The watercraft platform 301 is pivotally attached to the adjustable telescoping member 310 with pin 303. The hydraulic actuators 308, powers the lift up and down. The adjustable telescoping members 310 and 311 do not have additional lug plates extending forward like other over-center 4-bar mechanism lifts, since it allows the booms 302 and 304 to be substantially vertical. This vertical orientation is important, since the adjustment of the lifting range will not substantially change the amount of over-center. Too much over-center will create the lift to lurch forward when lifting. Too little over-center puts the boat at risk of lowering in case of a hydraulic failure.

Figure 4:
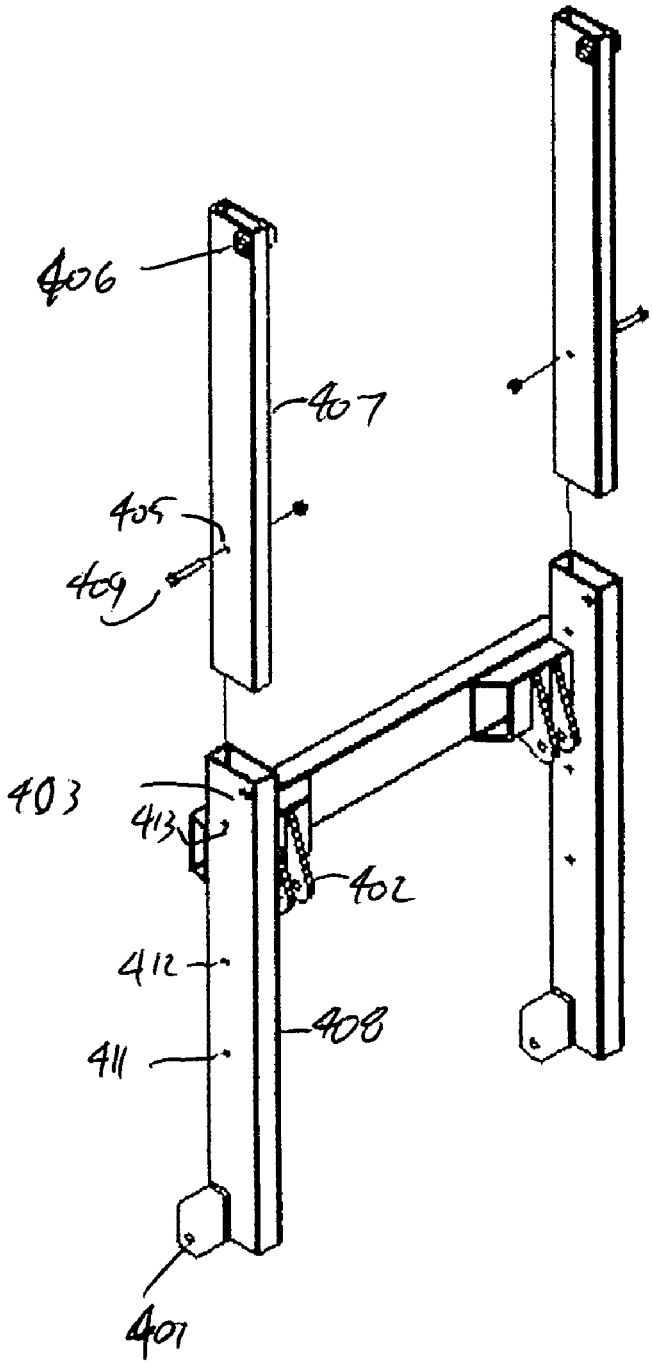
FIG. 4 is an enlarged, isometric, exploded view of the H frame of the watercraft lift of FIG. 3.

FIG. 4 is an isometric exploded view of the rear lifting boom in the preferred embodiment. This configuration shows a 3 foot range boom 408, and an Adjustable telescoping member 407 slides inside the lifting boom 408, and is pinned in place with pin 409 which is inserted into holes 409 and the one of the three adjustment holes 411, 412, 413. The upper shaft of the hydraulic actuator is pinned in hole 402. Hole 401 pivotally connects the lifting boom to the frame. A lifting range of 3 feet can be obtained by not using the telescoping member 407, and pinning the watercraft platform to the primary upper pivot hole 403. Lifting range of 4 feet or 5 feet can be obtained by pinning the adjustable telescoping member 407 to the lifting boom 408 using pin 409 and holes 405 and one of the adjustment holes 411, 412, 413. This configuration is preferred since it allows the user to have a full range of range adjustability from 3 feet to 5 feet.

Figure 5:
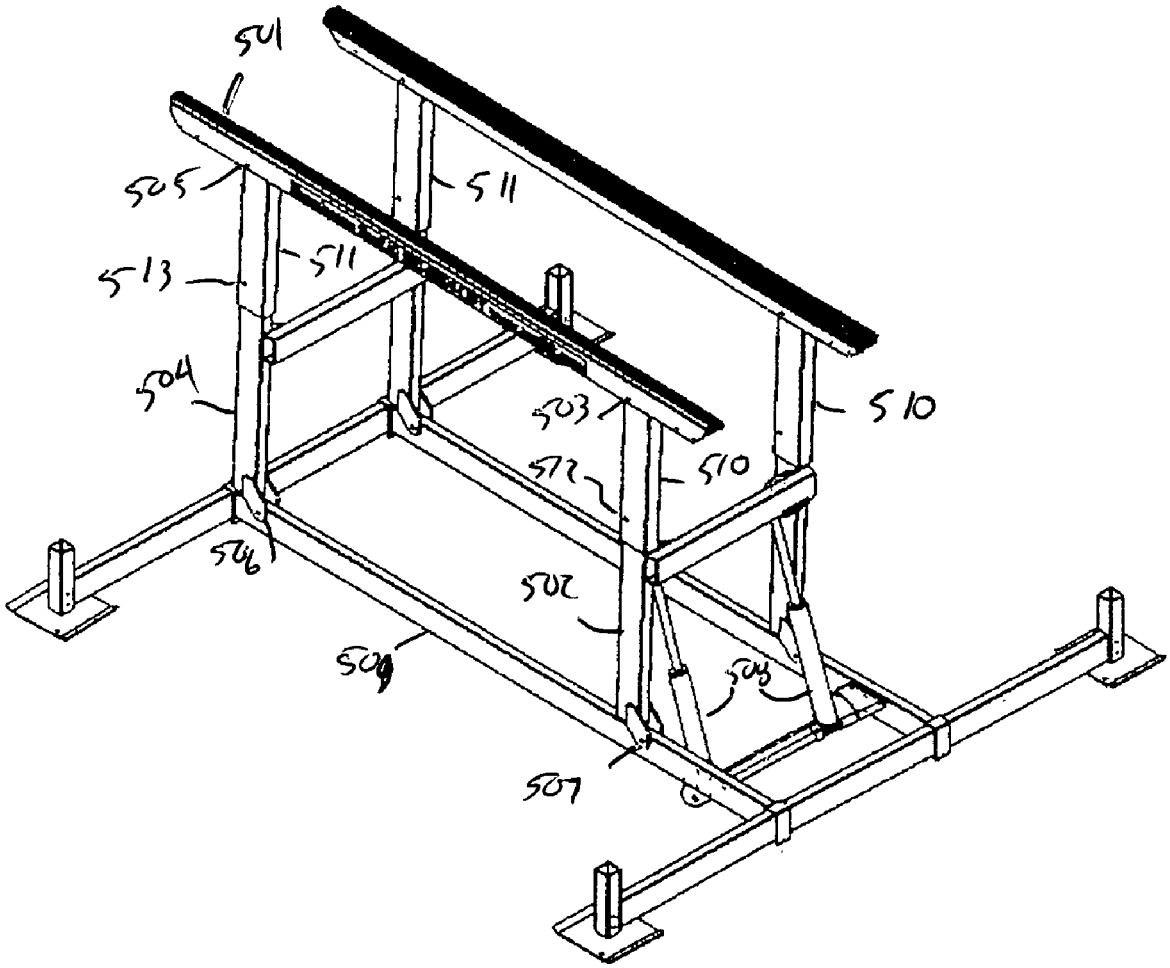
FIG. 5 is an isometric view of a second embodiment of the watercraft lift of FIG. 3.

FIG. 5 is a isometric view of a preferred embodiment of the boat lift in the 5 foot range configuration, in the highest and over-center position. The watercraft platform 501 is close to parallel in relation to the frame 509, which allows the boat to sit horizontally. The rear boom 502 is pivotally attached to the frame 509 with hole and pin 507. The upper pivot hole of the adjustable telescoping member 510 is pivotally attached to the watercraft platform 501. The adjustable telescoping member 510 is secured to the rear boom with pin 512. The forward boom 504 is pinned to the frame 509 with pin 506. The watercraft platform 501 is pivotally attached to the adjustable telescoping member 513 with pin 505. The hydraulic actuators 508, powers the lift up and down. The adjustable telescoping members 510 and 511 have only one hole visible for aesthetic benefit. The adjustable telescoping members do not have additional lug plates extending forward like other over-center 4-bar mechanism lifts, since it allows the booms 502 and 504 to be substantially vertical. This vertical orientation is important, since the adjustment of the lifting range will not substantially change the amount of over-center. Too much over-center will create the lift to lurch forward when lifting. Too little over-center puts the boat at risk of lowering in case of a hydraulic failure.

Figure 6:
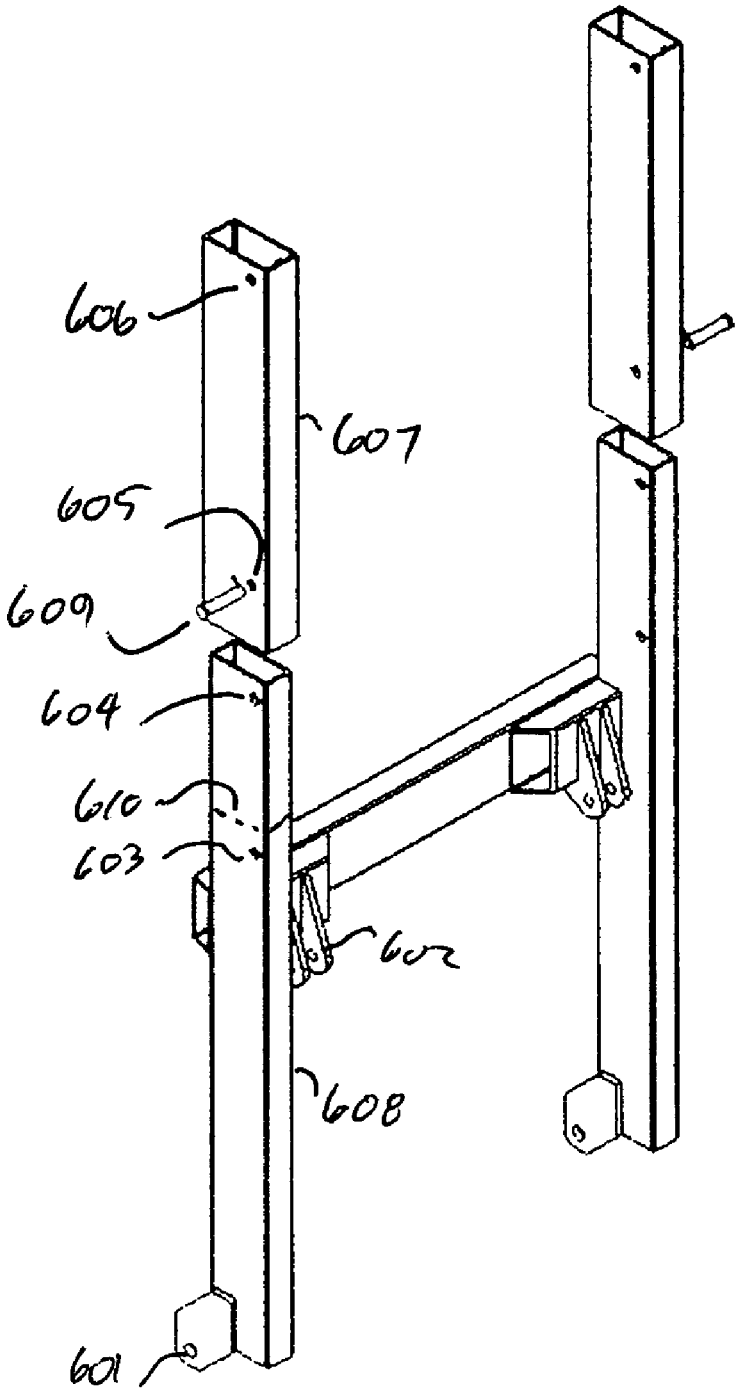
FIG. 6 is an enlarged, isometric view of the H frame of the watercraft lift of FIG. 5.

FIG. 6 is an isometric exploded view of the rear lifting boom in the preferred embodiment. Adjustable telescoping member 607 slides over the lifting boom 608, and is pinned in place with pin 609 which is inserted into holes 603 and 605. The upper shaft of the hydraulic actuator is pinned in hole 602. Hole 601 pivotally connects the lifting boom to the frame. The standard lifting range of 4 feet can be obtained by not using the telescoping member 607, and pinning the watercraft platform to the primary upper pivot hole 604. Lifting range of 5 feet can be obtained by pinning the adjustable telescoping member 607 to the lifting boom 608 using pin 609 and holes 603 and 605. The lifting boom 608, can be cut along dashed line 610 to reduce the lifting range to 3 feet. This configuration is preferred since 4 ft range model is the most popular and does not require any additional parts, nor cutting.

Figure 7:
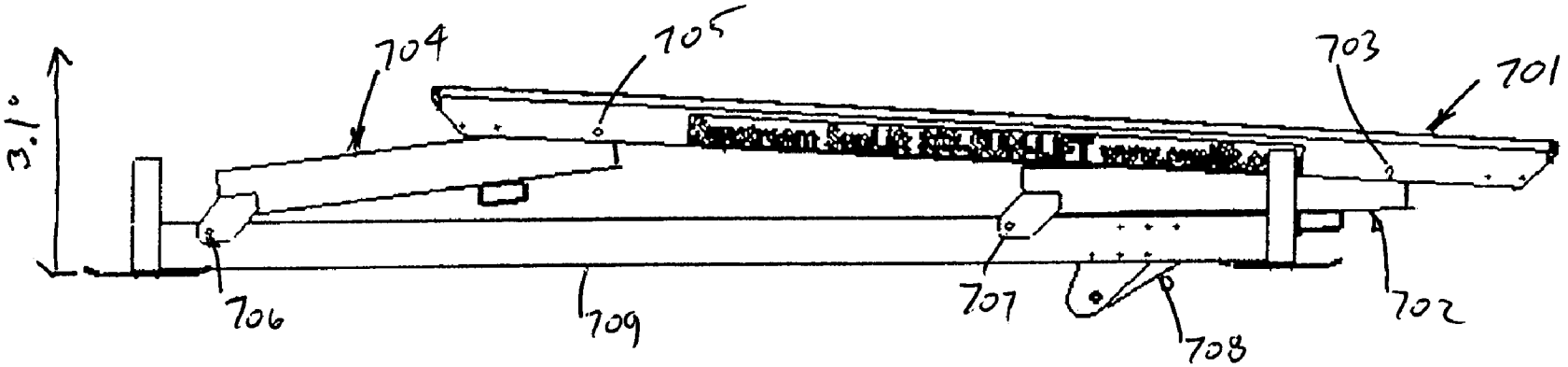
FIG. 7 is a side view of a watercraft lift incorporating the present invention showing the lift in the down position adjusted to a three- foot range.

FIG. 7 is a side view of a preferred embodiment of the boat lift in the 3 foot range configuration, in the lowest position. The watercraft platform 701 is at a 3 degree angle in relation to the frame 709. This reduced bunk angle allows the lift to operate in shallower water. The loads stay within design limits, even though the 4-bar linkage is approaching a short-couple condition, since the shorter booms result in lower resulting loading, given the same boat weight. The rear boom 702 is pivotally attached to the frame 709 with hole and pin 707. The secondary upper pivot hole 703 is pivotally attached to the watercraft platform 701. The forward boom 704 is pinned to the frame 709 with pin 706. The watercraft platform 701 is pivotally attached to the forward boom 704 with pin and secondary upper pivot hole 705. The slope of the four-bar linkage is created since the distance between holes 705 and 706 of the forward boom 704 is approximately 2 inches greater than the distance between holes 703 and 707 of the rear boom. The hydraulic actuator 708, powers the lift up and down.

Figure 8:
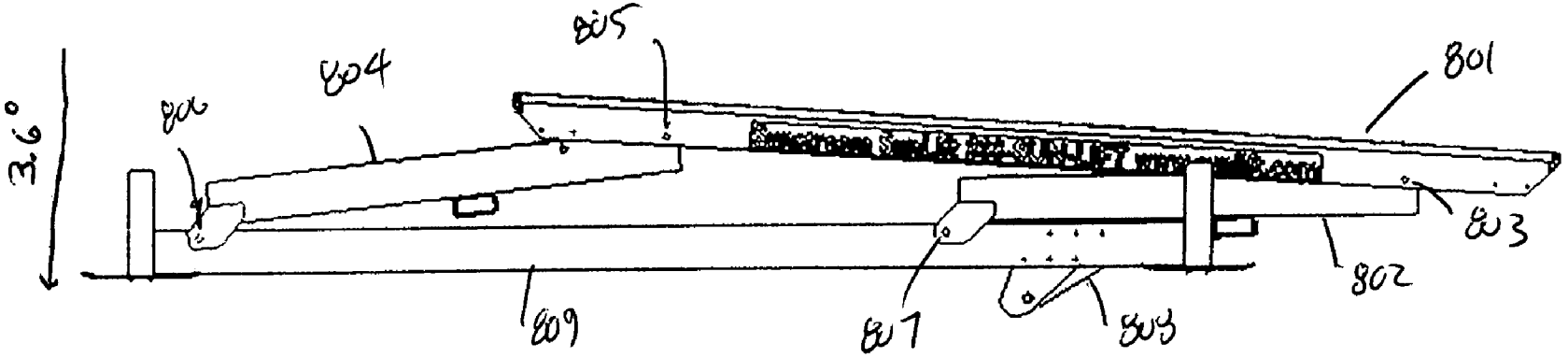
FIG. 8 is a side view of the watercraft lift of FIG. 7 showing the lift in the down position adjusted to a four-foot range.

FIG. 8 is a side view of a preferred embodiment of the boat lift in the 4 foot range configuration, in the lowest position. The watercraft platform 801 is at a 3.5 degree angle in relation to the frame 809. This bunk angle allows the lift to operate in as shallower water as possible. The rear boom 802 is pivotally attached to the frame 809 with hole and pin 807. The primary upper pivot hole 803 is pivotally attached to the watercraft platform 801. The forward boom 804 is pinned to the frame 809 with pin 806. The watercraft platform 801 is pivotally attached to the forward boom 804 with pin and primary upper pivot hole 805. The slope of the four-bar linkage is created since the distance between holes 805 and 806 of the forward boom 804 is approximately 2 inches greater than the distance between holes 803 and 807 of the rear boom. The hydraulic actuator 808, powers the lift up and down.

Figure 9:
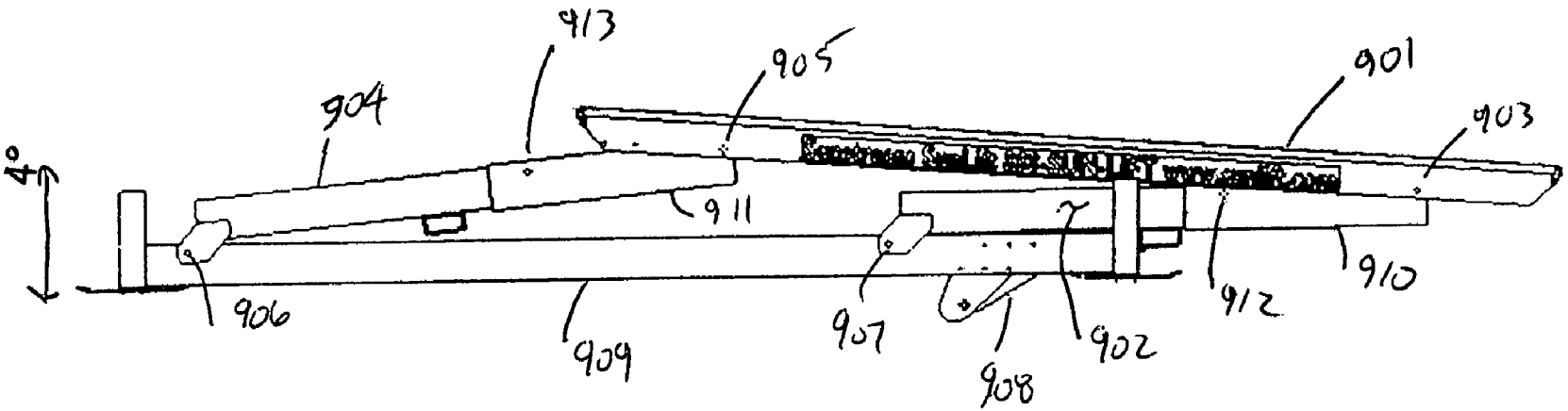
FIG. 9 is a side view of the watercraft lift of FIG. 7 showing the lift in the down position adjusted to a five-foot range.

FIG. 9 is a side view of a preferred embodiment of the boat lift in the 5 foot range configuration, in the lowest position. The watercraft platform 901 is at a 4 degree angle in relation to the frame 809. This bunk angle is steeper than the 4 foot and 3 foot ranges of FIGS. 7 and 8 respectively. The steeper angle helps to offset the increased load caused by the extended lifting boom 902. The rear boom 902 is pivotally attached to the frame 909 with hole and pin 907. The upper pivot hole of the adjustable telescoping member 903 is pivotally attached to the watercraft platform 901. The adjustable telescoping member 910 is secured to the rear boom with pin 912. The forward boom 904 is pinned to the frame 909 with pin 906. The watercraft platform 901 is pivotally attached to the adjustable telescoping member 913 with pin 905. The slope of the four-bar linkage is created since the distance between holes 905 and 906 of the forward boom 904 is approximately 2 inches greater than the distance between holes 903 and 907 of the rear boom. The hydraulic actuator 908, powers the lift up and down.

Figure 10:
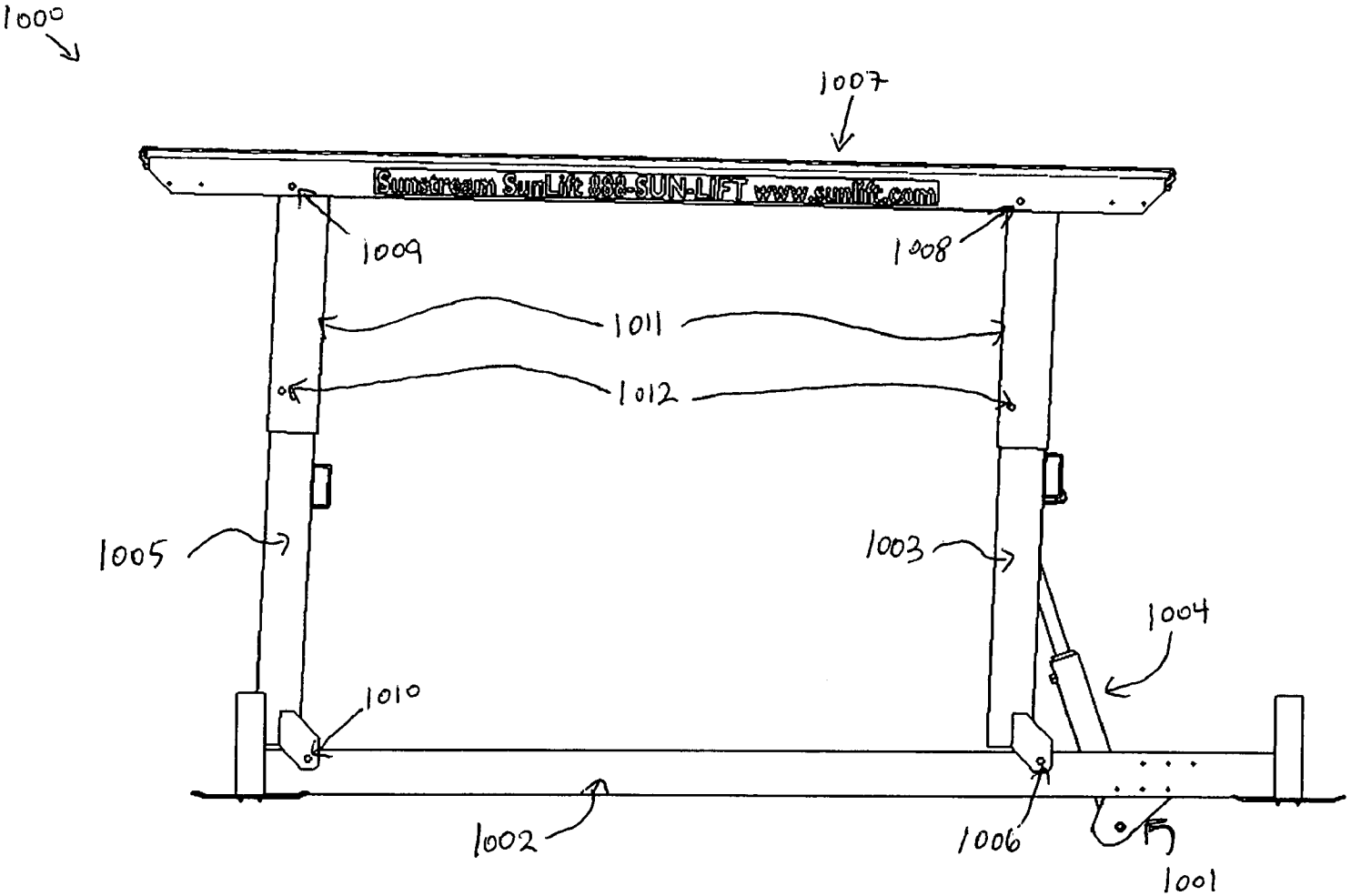
FIG. 10 is a side view of the present invention with extension member in a raised position.

FIG. 10 is a side view of the preferred embodiment of the boat lift, with extension member in the raised position. The lower cylinder attachment 1001 is rigidly attached to the base 1002. The rear boom 1003 is pivotally attached to base 1002 with pin 1006. The hydraulic actuator 1004 is pivotally attached to lower cylinder attachment 1001 and the hydraulic actuator 1004 is pivotally attached to the rear boom 1003. The rear boom 1003 is pivotally attached to the base 1002 relative to lower cylinder attachment 1001 such that when hydraulic actuator 1004 is fully extended the rear boom 1003 is in a near vertical position. The telescoping member 1011 is slideably attached to rear boom 1003 and forward boom 1005 with pin 1012. The watercraft platform 1007 is pivotally attached to telescoping members 1011 with pin 1008 and pin 1009. The forward boom 1005 is pivotally attached to base 1002 with pin 1010 in a manner that when hydraulic actuator 1004 is fully extended the forward boom 1005 is near vertical. The near vertical position of rear boom 1003 allows the horizontal distance between pin 1006 and pin 1008 and pin 1012, attached to rear boom 1003, and pin 1008 to be approximately equal.

It will be appreciated that, although specific embodiments of the invention have been described herein for purposes of illustration, various modifications may be made without departing from the spirit or scope of the invention. Accordingly, the invention is not limited except as by the appended claims.

What is claimed is:

1. A watercraft lift apparatus comprising:

a base;

a watercraft platform;

a first boom pivotally connected to the base;

a second boom pivotally connected to the base;

an extension member adjustably telescopically mounted to each of the first and second booms and pivotally connected to the watercraft platform; and an actuator mounted to rotate the first and second booms about their pivotal connections to the base to move the watercraft platform between a lowered position and a raised position.

2. The watercraft lift apparatus of claim 1 wherein the extension members are telescopically mounted to the first and second booms in the same manner.

3. The watercraft lift apparatus of claim 1 wherein the adjustable extension members each include a first pivot hole located at an upper end portion of the extension member and the extension member is pivotally connectable to the watercraft platform using the first pivot hole.

4. The watercraft lift apparatus of claim 3 wherein the extension members each include a second pivot hole located below the first pivot hole and the extension member is pivotally connectable to the watercraft platform using the second pivot hole if the upper end portion of the extension member containing the first pivot hole is removed to shorten the extension member.

5. The watercraft lift apparatus of claim 4 wherein the slope of the watercraft platform when using the second pivot hole is less than the slope of the watercraft platform when using the first pivot hole.

6. The watercraft lift apparatus of claim 1 wherein the slope of watercraft platform decreases as the extension members are retracted relative to the first and second booms.

7. The watercraft lift apparatus of claim 1 wherein the extension members are detachable from the first and second booms, and when detached the first and second booms are configured for pivotal connection to the watercraft platform.

8. The watercraft lift apparatus of claim 1 wherein the first and second booms are in an overcenter position when the watercraft platform is in the raised position.

9. The watercraft lift apparatus of claim 8 wherein the first and second booms are in the range of 1 degree to 12 degrees overcenter from vertical when the watercraft platform is in the raised position.

10. A watercraft lift apparatus comprising:

a base;

a first boom pivotally connected to the base and having a primary first pivot hole located at the upper end portion of the first boom and a second pivot hole located at a position on the first boom below the first pivot hole, the second pivot hole being usable as the primary pivot hole upon removal of the upper end portion of the first boom;

a second boom pivotally connected to the base and having a primary first pivot hole located at the upper end portion of the second boom and a second pivot hole located at a position on the second boom below the first pivot hole, the second pivot hole being usable as the primary pivot hole upon removal of the upper end portion of the second boom;

a watercraft platform pivotally connected to the first and second booms; and an actuator mounted to rotate the first and second booms relative to the base and the watercraft platform to move the watercraft platform between a lowered position and a raised position.

11. The watercraft lift apparatus of claim 10 wherein the slope of the watercraft platform when using the second pivot hole is less than the slope of the watercraft platform when using the first pivot hole.

12. The watercraft lift apparatus of claim 10 wherein the first and second booms are in an overcenter position when the watercraft platform is in the raised position.

13. The watercraft lift apparatus of claim 12 wherein the first and second booms are in the range of 1 degree to 12 degrees overcenter from vertical when the watercraft platform is in the raised position.

14. A watercraft lift apparatus comprising:

a base;

a first boom pivotally connected to the base;

a second boom pivotally connected to the base;

a watercraft platform pivotally connected to the first and second booms;

an extension member adjustably telescopically extending from the first and second booms and pivotally connected to the watercraft platform; and an actuator assembly consisting of at least one hydraulic cylinder and operable to rotate the first and second booms about their pivotal connections to the base to move the watercraft platform between a lowered position and a raised position.

15. The watercraft lift apparatus of claim 14 wherein the adjustable telescoping extension members each include a primary first pivot hole and a second pivot hole located below the first pivot hole, the second pivot hole being usable as a primary pivot hole upon removal of a portion of the extension member containing the first pivot hole.

16. The watercraft lift apparatus of claim 15 wherein the slope of the watercraft platform when using the second pivot hole is less than the slope of the watercraft platform when using the first pivot hole.

17. The watercraft lift apparatus of claim 14 wherein the slope of watercraft platform decreases as the extension members are retracted relative to the first and second booms.

18. The watercraft lift apparatus of claim 14 wherein the extension members are detachable from the first and second booms, and when detached the first and second booms are configured for pivotal connection to the watercraft platform.

19. The watercraft lift apparatus of claim 14 wherein the first and second booms are in an overcenter position when the watercraft platform is in the raised position.

20. A watercraft lift apparatus comprising:

a base having forward and rearward end portions and left and right side portions;

left and right side laterally spaced apart watercraft support members;

first and second booms pivotally connected to the base at the forward end portion;

third and fourth booms pivotally connected to the base at the rearward end portion, the first and third booms being located toward the left side portion of the base, and the second and fourth booms being located toward the right side portion of the base;

an extension member adjustably telescopically mounted to each of the first, second, third and fourth booms, the extension members of the first and third booms being pivotally connected to the left side watercraft support member, and the extension members of the second and fourth booms being pivotally connected to the right side watercraft support member; and an actuator mounted to rotate the first, second, third and fourth booms about their pivotal connections to the base to move the left and right watercraft support members between a lowered position and a raised position.

21. The watercraft lift apparatus of claim 20 wherein the first, second, third and fourth booms each have an elongated end portion extending along a longitudinal axis, and the extension member mounted thereto is telescopically mounted to move along the longitudinal axis.

* * * * *